US005722564A

United States Patent [19]

Tiraboschi

[11] Patent Number: 5,722,564

[45] Date of Patent: Mar. 3, 1998

[54] AUTOMATIC BANK MACHINE FOR DISTRIBUTING ROLLS OF COINS

[76] Inventor: Patrick Tiraboschi, Bastide Saint-Paul, Domaine du Vignal, F-06740 Chateauneuf de Grasse, France

[21] Appl. No.: 617,791

[22] PCT Filed: Sep. 5, 1994

[86] PCT No.: PCT/FR94/01038

§ 371 Date: Mar. 22, 1996

§ 102(e) Date: Mar. 22, 1996

[87] PCT Pub. No.: WO95/08817

PCT Pub. Date: Mar. 30, 1995

[30] Foreign Application Priority Data

Sep. 22, 1993 [FR] France ..... 93 11379

[51] Int. Cl.[6] ..... G07F 11/52

[52] U.S. Cl. ..... 221/131; 221/266

[58] Field of Search ..... 221/79, 82, 105, 221/131, 132, 266

[56] References Cited

U.S. PATENT DOCUMENTS

| | | | |
|---|---|---|---|
| 3,036,732 | 5/1962 | Schaef | 221/113 |
| 3,180,521 | 4/1965 | Di Domenico et al. | 221/105 |
| 4,282,892 | 8/1981 | Burnside | 221/266 X |
| 4,469,245 | 9/1984 | Fish et al. | 221/225 |
| 5,176,285 | 1/1993 | Shaw | 221/79 X |

FOREIGN PATENT DOCUMENTS

| | | |
|---|---|---|
| 0 289 672 | 11/1988 | European Pat. Off. . |
| 0 319 492 | 6/1989 | European Pat. Off. . |
| 90 02 363.3 | 6/1990 | Germany . |
| 41 01 809 | 5/1992 | Germany . |

*Primary Examiner*—F. J. Bartuska
*Attorney, Agent, or Firm*—Young & Thompson

[57] ABSTRACT

Automated teller machine for dispensing coin rolls, comprising one or more vertical coin roll (2) dispensing wheels (9), the rolls are arranged in chutes (10) radially disposed about its rotational axis (11). Each wheel is enclosed in a circular fairing (12) which comprises, in the upper portion, a window (13) for loading the coin rolls and, in the lower portion, a window (14) for dispensing by gravity the coin rolls. The lower dispensing widow cooperates with elements (19) for controlling a receptacle (15) for opening and closing the latter, elements for controlling the dispensing receptacle and elements (20) for stepwise rotation of the wheel.

10 Claims, 5 Drawing Sheets

AUTOMATIC BANK MACHINE FOR DISTRIBUTING ROLLS OF COINS

FIELD OF THE INVENTION

The present invention relates to an automatic bank machine used for distributing rolls of coins. This has the form of a kiosk having a built-in cash dispenser.

It has on its forward surface which is accessible to the public, means permitting the transaction such as a keyboard, a display screen or the like.

BACKGROUND OF THE INVENTION

The prior art provides apparatus of this type for the dispensing of bills or foreign currency, etc.

The document FR-A-2.333.305 relates to automatic bank note dispensers. The device of the invention comprises a computer associated with a memory and connected by a telecommunication line to a remote terminal comprising a bank note dispenser. To improve security of the transactions, the device is designed so as to avoid any transmission over the data line whose detection might lead to fraudulent use of the dispenser.

The document FR-A-2.589.606 provides a self-service bank device comprising a cash dispenser. It comprises a kiosk enclosing a cash dispenser having a keyboard suitable for users, disposed in a forward wall of the kiosk. The cash dispenser comprises a safe enclosing a cash dispenser and a money deposit device when the bank is closed. The kiosk comprises a movable portion which can pivot 90° so as to open the door of the safe as well as apparatus for dispensing and deposit. The kiosk comprises a closed and safe enclosure for a worker who has opened the door of the safe to provide maintenance or cash resupply operations.

At present, the dispensers for rolls of coins are generally produced in the form of a hopper which contains said rolls of coins. The essential problem with this type of structure arises by jamming between adjacent rolls falling by gravity, which can take place. This renders the dispensers rapidly unusable.

U.S. Pat. No. 4,469.245 discloses a bank machine which distributes rolls of coins. These rolls are disposed in bulk in a container, the rolls are moved toward the outlet of the dispenser by rolling means. These rolling means are provided with chains, clutches, inclined planes.

This distributor is out of use when there is jamming of the rolls. It has all the drawbacks which the present invention seeks to overcome.

U.S. Pat. No. 3.036.732 discloses a dispenser of small light objects such as pens. These pens are disposed in one of several vertical wheels. The movement of the wheels is insured by the action of the user on a rotatable knob. The vertical wheels are disposed in a plane parallel to the plane of the front of the dispenser so as to have an attractive appearance, the front panel being transparent.

All these devices are used for dispensing paper money, and their conversion would not be obvious for money in the form of rolls of coins. The present invention provides a distributor for rolls of coins which is very compact in that the rolls to be dispensed are stored in a minimum space, similar to what is easily provided for currency dispensers.

Moreover, the loading and unloading of the bank machine takes place quite simply.

SUMMARY OF THE INVENTION

To this end, the present invention provides a bank machine for dispensing rolls of coins, in the form of a kiosk, including an automatic teller, the kiosk having on its forward surface accessible to the public, means permitting the transaction such as a control keyboard, a visualization screen, openings for insertion of a payment means (bank card, bill or the like), outlet receptacles (distributed coin rolls, receipt recording the transaction conducted, coin changer) or the like which is characterized by the fact that it comprises one of several vertical wheels which serve as a dispensing drum for the coin rolls, said rolls being disposed in radiating recesses disposed about its axis of rotation; each wheel is comprised in a circular cage which comprises in its upper portion a window for loading said coin rolls and in the lower portion a window for the gravity dispensing of the coin rolls, said lower dispensing window coacts with control means of a shutter which permits opening and closing of the lower window, and control means of the dispensing shutter and means for rotating the wheel stepwise.

The radiating recesses containing the rolls are alternately long and short.

The width of a radiating recess is adapted to the diameter of the coin rolls stored therein.

The control means of the shutter are constituted by:

- the shutter whose concave portion permits the reception of only a single coin roll at a time.
- an axle of rotation of the shutter rotated by means such as an electric motor, or a jack.
- a skirt prolonging one of the edges of the shutter and having the shape of a section of a circle whose center is the axis of rotation of the shutter, such that when said shutter is rotated so as to free the coin roll it contains, the rolls still present in the radiating recess associated with the lower window are maintained in said recess.

The cage assembly and the wheel is inscribed in a vertical drawer comprising two windows coinciding with the two windows of said circular cage of the wheel.

At least one of the corners of the drawer contains control means for the shutter.

At least one of the corners of the drawer contains means for rotating said drum.

The stepwise rotation means comprise a motor and a transmission means such as gearing, a chain, a pulley, or the like, for transmitting rotation of the motor to the dispensing drum.

The coin rolls are disposed with their longitudinal axis perpendicular to the vertical plane of the wheel.

BRIEF DESCRIPTION OF THE DRAWINGS

The accompanying drawings are given by way of example and are not limitative. They show a preferred embodiment according to the invention. They permit easy comprehension of the invention.

Finally.

DETAILED DESCRIPTION OF THE INVENTION

Figure 8:
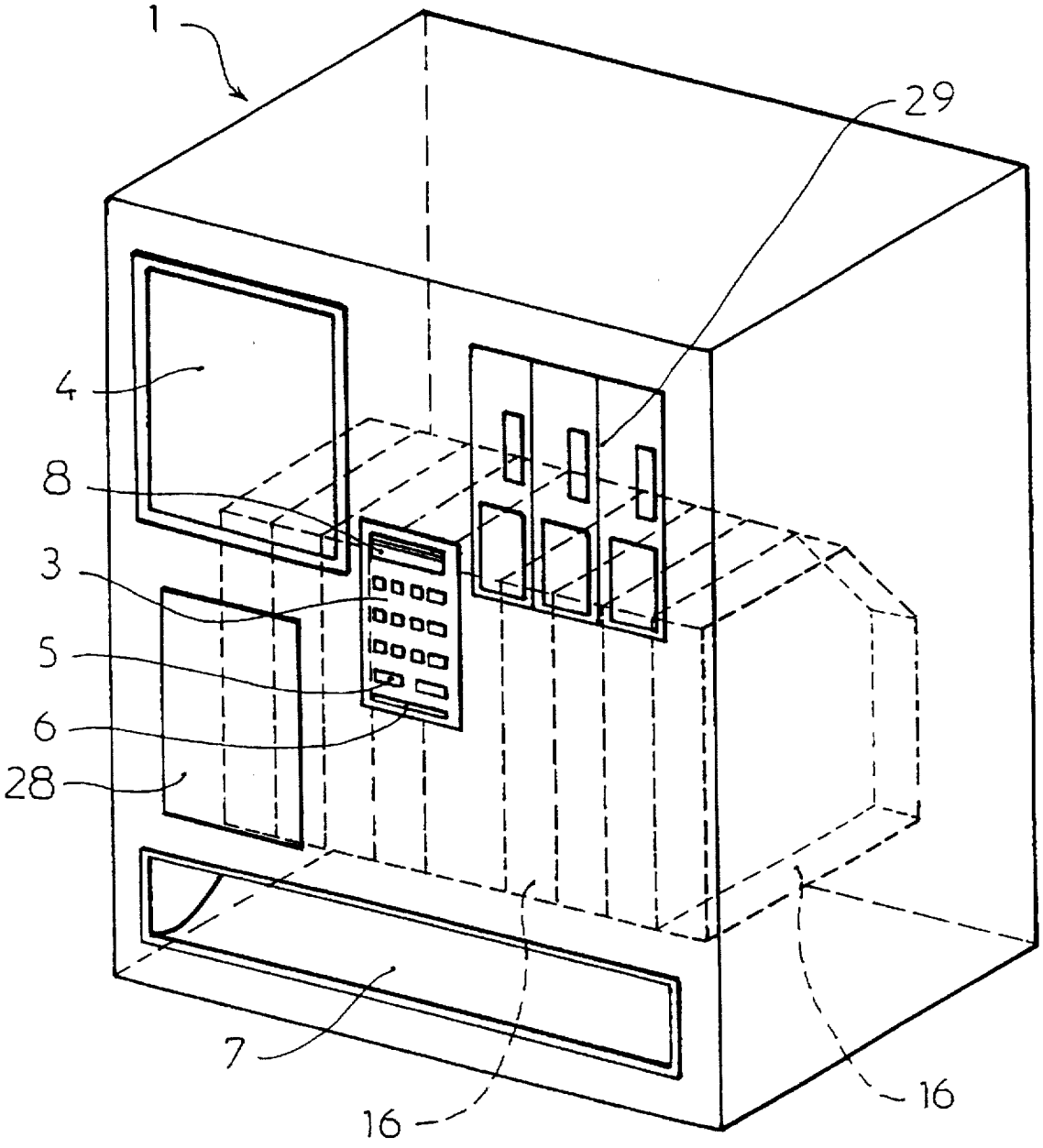
FIG. 8 is a perspective view of a bank machine according to the invention.

The present invention relates to a bank machine 1 such as shown in FIG. 8.

Figure 5:
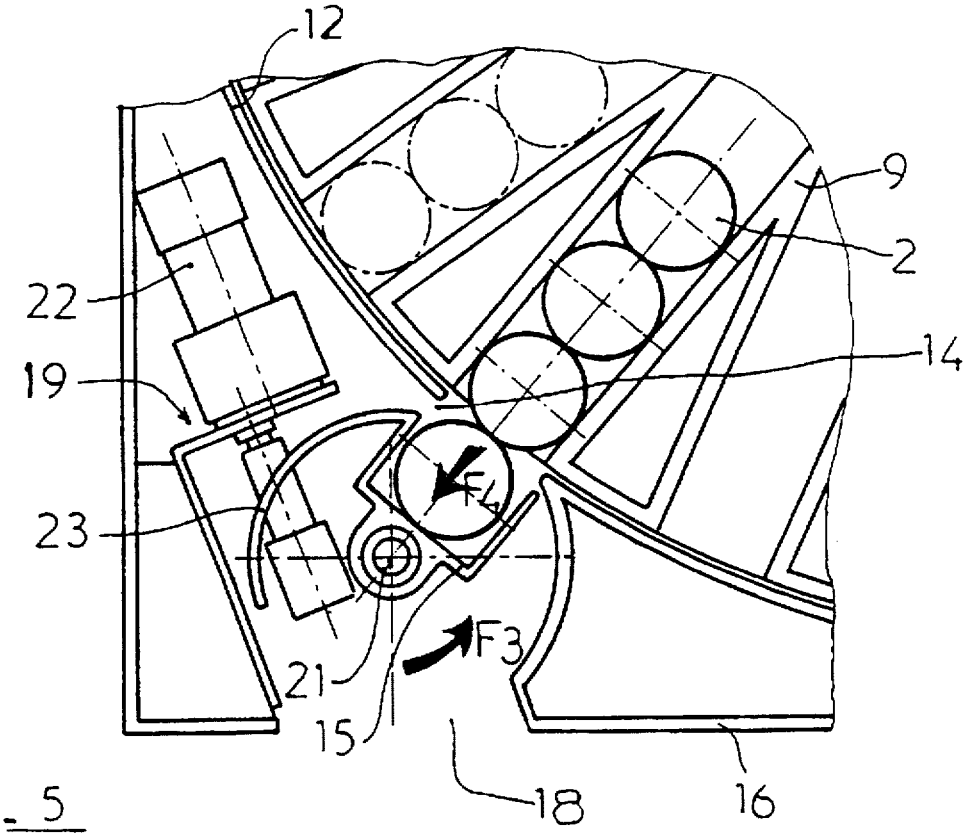
FIG. 5 is a detail view of the control means of the shutter, shown in FIG. 4, when the shutter receives a coin roll.
Figure 6:
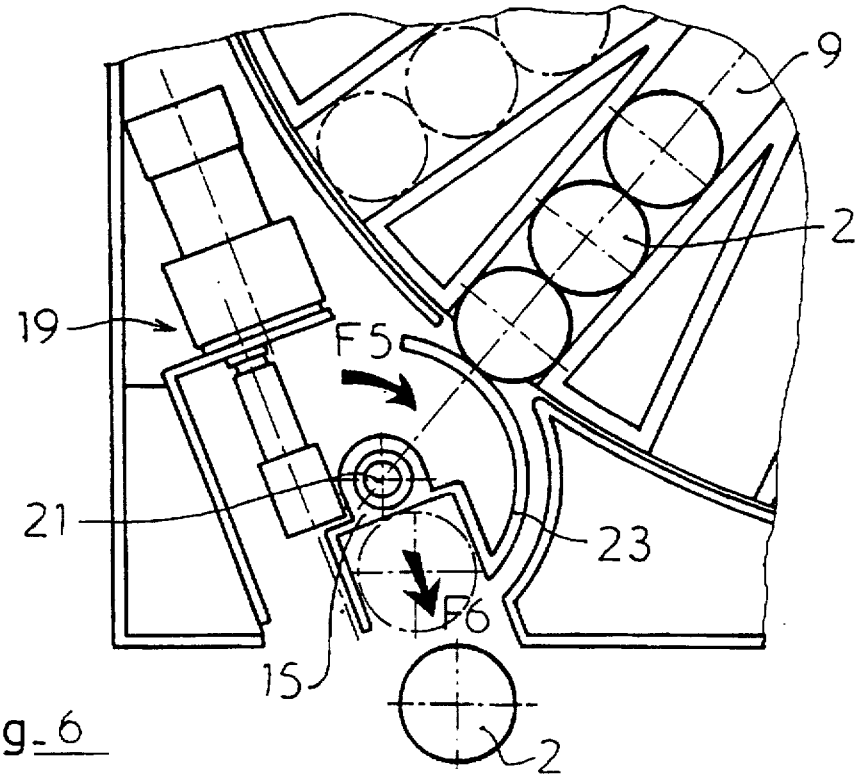
FIG. 6 is a detail view of the control means of the shutter, shown in FIG. 4, when the shutter distributes the coin roll it contains.

This bank machine 1 permits the dispensing of rolls of coins 2, more particularly shown in FIGS. 5 and 6.

According to FIG. 8, this machine 1 is in the form of a kiosk having an incorporated automatic teller.

The kiosk has on its forward surface, which is the portion accessible to the public, means permitting the public to conduct money transactions such as dispensing coin rolls 2 as a function of a certain sum inserted which can be given by the public either with the aid, for example, of a bank card, thanks to the insertion opening 5, or by means of bank notes through the insertion opening 6 for bills, or the like.

This forward surface also comprises elements such as a control keyboard 3 permitting selecting the value of the money distributed, as well as its quantity, but also a display screen 4 permitting the user to see at any moment the controls he has effected as well as the controls he must effect. The screen 4 permits visualizing the commission charged by the machine 1 for the service rendered.

Other devices permitting facilitating the use of the bank machine 1 can also be added without thereby departing from the scope of the present invention.

Likewise, the outlet receptacles 7 or 8 can be provided either to permit the reception of the dispensed coin rolls 2, or the reception of a slip reciting the operation effected.

The essence of the present invention consists in that the bank machine 1 comprises at least one vertical wheel 9 serving as a distribution drum for the coin rolls 2.

According to a preferred embodiment, the vertical wheel or wheels are disposed perpendicularly to the forward face of the dispenser or bank machine.

The rolls 2 are disposed as clearly shown in FIGS. 5 and 6 with a longitudinal axis in a position perpendicular relative to the vertical plane of the wheel 9.

This positioning is facilitated by the presence of radiating recesses 10*a* or 10*b* which are disposed entirely about the axis of rotation 11 of the drum 9.

Moreover, each drum 9 is comprised within the interior of a circular cage 12 which perfectly matches the external shape of the drum 9, except for two windows provided in the upper portion 13, but also in the lower portion 14.

Figure 4:
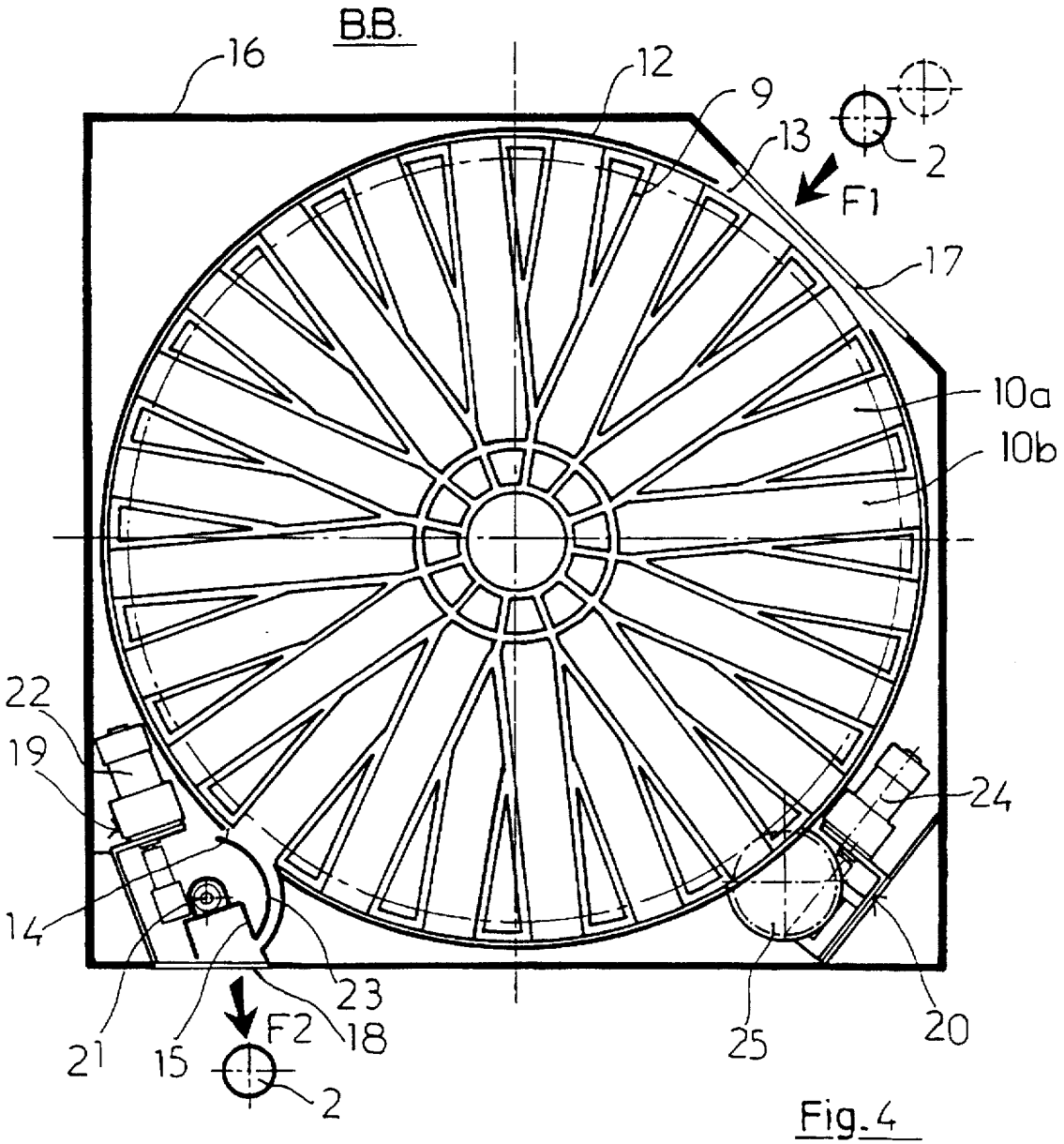
FIG. 4 is a cross-section on the line B—B of FIG. 3.

The upper window 13 having for its object to permit loading in the direction of the arrow F1 of FIG. 4, the lower window permits the dispensing of the coin rolls 2 in the direction of arrow F2.

Opposite the window 14 is a shutter 15, permitting the dispensing of the rolls 2 present within the radiating recess 10*a* or 10*b* located in registry therewith.

This is clear from FIG. 5.

In this Figure, the coin rolls tend to leave the drum 9 by mere gravity, as well as to leave the cage 9 through the lower window 14.

Because of this, and because of the limited space within the shutter 15, only a single roll 2 can find its way into the shutter 15.

This displacement takes place in the direction of arrow F4.

Of course, to reach this result, the shutter 15 has effected a rotation F3 about its axis 21, thanks to the control means 19 which will be described in greater detail later.

The assembly of the wheel 9 and the cage 12 is disposed within a vertical drawer 16 which itself comprises also two windows 17 and 18, which coincide with the windows 13 and 14 of the circular cage 12 of the wheel 9.

Control means 19 for the shutter 15 as well as stepwise rotation means 20 for the wheel 9 are also comprised within the drawer 16.

As can be seen in FIG. 8, the number of the drawers 16 can be variable such that one can dispose within the interior of the same bank machine a certain number of vertical wheels parallel to each other.

Figure 1:
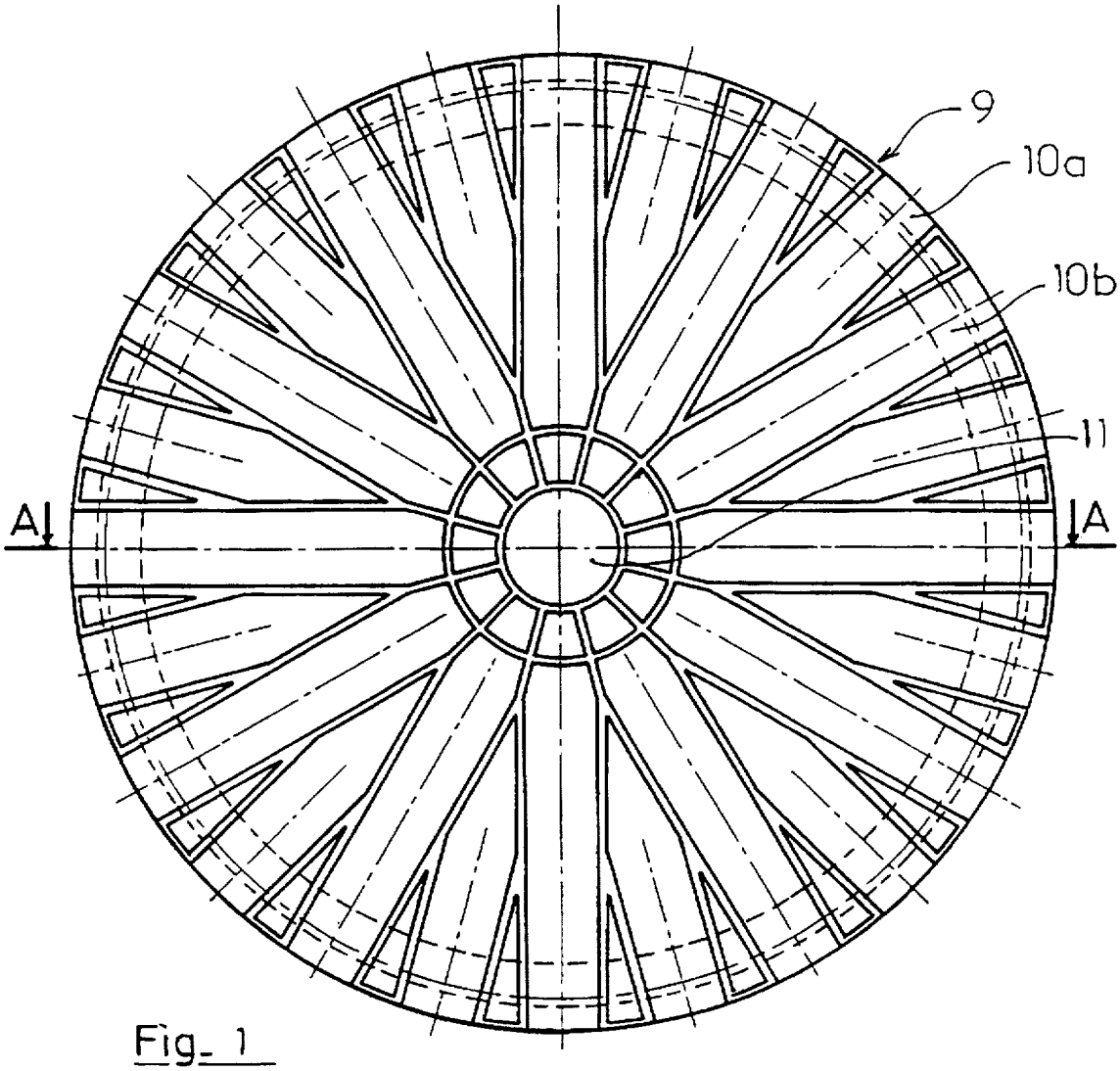
FIG. 1 is a cross-sectional view of a drum wheel.

As is seen in FIGS. 1 and 4, the radiating recesses 10*a* and 10*b* are alternately long and short, such that a maximum number of coin rolls 2 can be stored by the wheel 9.

Of course, the width of a radiating recess 10*a* or 10*b* corresponds to the diameter of the coin rolls 2 which are stored therein.

The diameter of the rolls 2 is thus substantially less than the width of each radiating recess 10*a* or 10*b*, so as to permit sliding by simple gravity, no matter what the load, in the direction of the arrow F1 or the dispensing in the direction of the arrow F2.

The control means 19 shown in FIGS. 5 and 6 are constituted on the one hand by the shutter 15 whose concave portion permits, as was previously seen, the reception of a single coin roll 2 at a time.

On the other hand, its rotational axle 21 is moved in rotation by means such as an electric motor 22 or the like.

Finally, a last element of the control means 19 comprises a skirt 23 prolonging one of the edges of the shutter 15.

This skirt 23 has the shape of a section of a circle, the center is the axle 21 of rotation of the shutter 15, such that said shutter 15 is rotated in the direction of arrow F5 so as to free the shutter from rolls 2 in the direction of arrow F6.

The roll or rolls 2 still present in the radiating recess 10*a* and 10*b* facing the lower window 14 are maintained within said recess 10*a* or 10*b*.

The control means 19 are present within the interior of one of the corners of drawer 16 and are thus comprised between the internal surface of drawer 16 and the external surface of the cage 12 which contains the wheel 9. Similarly, the stepwise rotation means 20 are inserted in one of the corners formed by the drawer 16 and their space is limited by the presence of the cage 12.

The position of these stepwise rotation means 20 is not limited to a particular corner of the machine 1; this corner can be located in an upper or lower position, whilst for the control means 19, a lower position is recommended so as to facilitate the exit of the rolls 2 by gravity.

Figure 7:
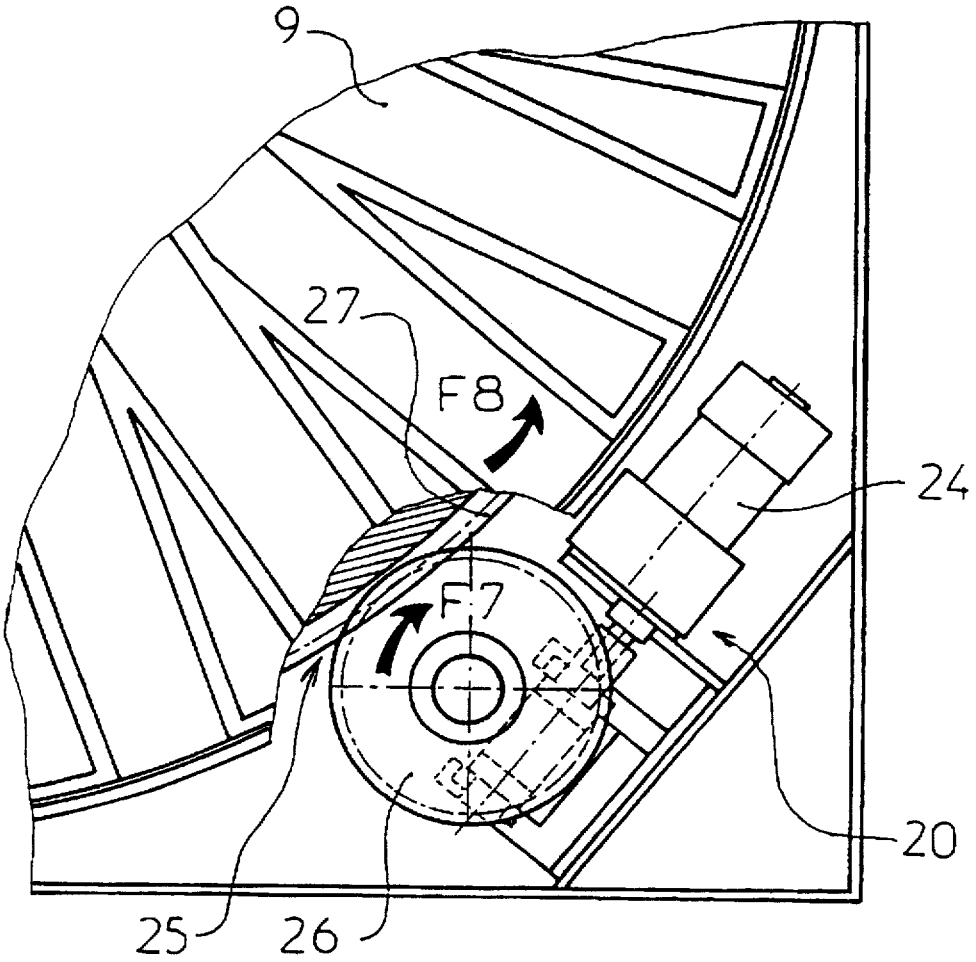
FIG. 7 is a detail view of the stepwise rotation means of the dispensing wheel, shown in FIG. 4.

These stepwise rotation means comprise, moreover, a motor 24 as well as transmission means such as gearing 25, as is shown in FIG. 7, which transmits the rotative movement of the motor 24 to the dispensing drum 9.

Figure 2:
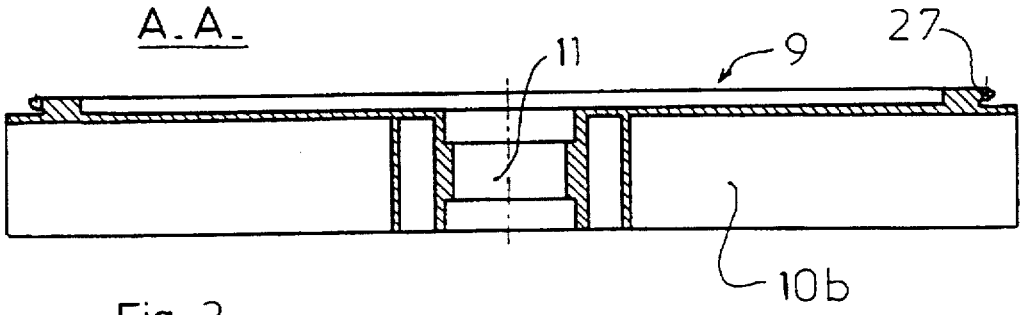
FIG. 2 is a cross-section on the line A—A of FIG. 1.
Figure 3:
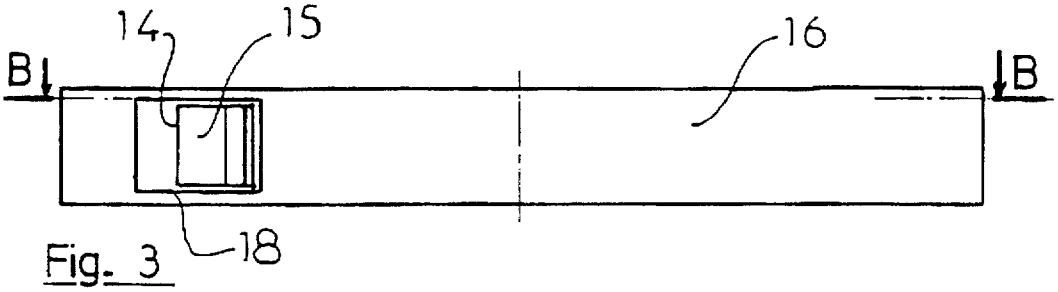
FIG. 3 is a view from below of a drawer containing a wheel or dispensing drum for coin rolls.

This movement transmission takes place with the help of a toothed wheel 26 present in the rotation means 20 which comprises with a toothed wheel 27, present in the drum 9, as is shown in FIGS. 2 and 7, the gear ring 25.

The toothed wheel 26 turns in the direction of arrow F7 which causes a movement in the direction of arrow F8 of the toothed wheel 27.

This movement is a movement which takes place stepwise such that the external opening of each radiating recess 10*a* or 10*b* is present in turn at the lower window 14, and then at the upper window 13.

Other elements can be disposed on the forward surface of the machine 1, such as an instruction panel 28, to facilitate the use of said machine 1, or a money changer 29 for giving change.

REFERENCES

1. Bank Machine

2. Coin Rolls

3. Control Keyboard

4. Display Screen

5. Opening for Inserting a Bank Card

6. Opening for Inserting Bills

7. Outlet Receptacle for Coin Rolls 2

8. Outlet Receptacle for a Slip Reciting the Effected Operation

9. Vertical Wheel or Dispensing Drum

10*a*, 10*b*. Radiating Recesses of Each Wheel 9

11. Rotational Axle of Each Wheel 9

12. Circular Cage

13. Upper Window for Loading the Cage 12

14. Lower Window for Dispensing from the Cage 12

15. Dispensing Shutter Coacting with the Lower Window 14

16. Vertical Drawer

17. Upper Window of the Drawer 16

18. Lower Window of the Drawer 16

19. Control Means of the Shutter 15

20. Stepwise Rotation Means for the Wheel 9

21. Rotational Axle of the Shutter 15

22. Electrical Motor of the Control Means 19

23. Skirt of the Shutter 15

24. Motor

25. Gearing

26. Toothed Wheel of the Rotation Means 20

27. Toothed Wheel of a Drum 9

28. Instruction Panel

29. Money Changer

F1. Direction of Loading of Rolls 2

F2. Direction of Dispensing of Rolls 2

F3. Upward Pivoting of the Shutter 15

F4. Gravity Discharge of a Roll 2 in the Shutter 15

F5. Downward Pivoting of the Shutter 15

F6. Fall by Gravity of a Roll 2 From the Shutter 15

F7. Direction of Rotation of the Toothed Wheel 26

F8. Direction of Rotation of the Toothed Wheel 27

What is claimed is:

1. In a bank machine for dispensing coin rolls, comprising a kiosk with incorporated automatic teller, the kiosk having on its forward surface accessible to the public means including a control keyboard for permitting a transaction, a display screen, openings for the insertion of payment means, an outlet receptacles, the improvement wherein said machine further comprises: one or several vertical wheels, each wheel serving as a distribution drum for coin rolls via a dispensing shutter, each wheel adapted to rotate about an axis of rotation, said rolls being disposed in radiating recesses disposed about the axis of rotation of each wheel, each wheel including control means of the dispensing shutter, and means for stepwise rotating the wheel, each wheel being disposed in a circular cage which includes in its upper portion a window for loading said coin rolls and in its lower portion a window for dispensing by gravity coin rolls, and said lower dispensing window coacting with the control means of the dispensing shutter which permits opening and closing the lower window.

2. Bank machine according to claim 1, wherein each vertical wheel is disposed perpendicularly to the forward surface of the bank machine.

3. Bank machine according to claim 1, wherein the radiating recesses of each wheel containing the rolls are alternately long and short.

4. Bank machine according to claim 1, wherein the width of a radiating recess is adapted to the diameter of the coin rolls which are stored therein.

5. Bank machine according to claim 1, wherein the control means of the shutter have a concave portion which permits the reception of only a single coin roll at a time, said control means of the shutter including:

means for rotating the shutter about a rotation axle, a skirt prolonging one of the edges of the shutter having the shape of a section of a circle whose center is the rotation axle of the shutter, such that when said shutter is moved in rotation so as to free the coin roll which it contains, any roll already present in the radiating recess facing the lower window is kept within said recess.

6. Machine according to claim 1, wherein each cage and wheel assembly is inscribed within a vertical drawer having two windows coinciding with the two windows of said circular cage of the wheel.

7. Machine according to claim 6, wherein at least one of the corners of the drawer contains the control means of the shutter.

8. Machine according to claim 6, wherein at least one of the corners of the drawer contains the means for stepwise rotating the wheel.

9. Machine according to claim 1, wherein the means for stepwise rotating comprise a motor and a transmission means for transmitting a rotative movement of the motor to the wheel.

10. Machine according to claim 1, wherein the coin rolls are disposed with their longitudinal axis perpendicular to the vertical plane of the wheel.

* * * * *